United States Patent [19]

Singh

[11] 4,196,043

[45] Apr. 1, 1980

[54] KRAFT PULP BLEACHING AND RECOVERY PROCESS

[75] Inventor: Rudra P. Singh, Ridley Park, Pa.

[73] Assignee: Scott Paper Company, Philadelphia, Pa.

[21] Appl. No.: 516,737

[22] Filed: Oct. 21, 1974

Related U.S. Application Data

[63] Continuation of Ser. No. 390,324, Aug. 21, 1973, abandoned, which is a continuation of Ser. No. 100,454, Dec. 21, 1970, abandoned.

[51] Int. Cl.[2] ..... D21C 9/16

[52] U.S. Cl. ..... 162/30 K; 162/40; 162/65; 162/78; 162/90

[58] Field of Search ..... 162/19, 30, 60, 65, 162/78, 37, 40, 90; 8/111

[56] References Cited

U.S. PATENT DOCUMENTS

| | | | |
|---|---|---|---|
| 1,683,262 | 9/1928 | Richter et al. | 162/89 X |
| 1,957,937 | 5/1934 | Campbell et al. | 162/19 |
| 2,147,618 | 2/1939 | Rawling | 162/65 |
| 3,366,534 | 1/1968 | Rapson | 162/30 |
| 3,382,149 | 5/1968 | Hoh | 162/65 X |
| 3,451,888 | 6/1969 | Ancelle et al. | 162/65 |
| 3,453,174 | 7/1969 | Rapson | 162/30 |
| 3,632,469 | 1/1972 | Wilder | 162/60 X |
| 3,740,308 | 6/1973 | Rapson | 162/30 X |
| 3,798,119 | 3/1974 | Singh | 162/65 |
| 3,867,246 | 2/1975 | Hebbel et al. | 162/78 X |

OTHER PUBLICATIONS

Rydholm, *Pulping Processes,* 1965, p. 583.

*Primary Examiner*—Arthur L. Corbin
*Attorney, Agent, or Firm*—Nicholas J. DeBenedictis; John W. Kane, Jr.; William J. Foley

[57] ABSTRACT

A Kraft pulp bleaching process comprising from one to about three treatments with ozone and a final treatment with an alkaline peroxide solution, the treatments being separated by an alkaline extraction, wherein effluent from the bleach treatments is utilized in subsequent bleaching operations or in the chemical recovery system of a Kraft pulping process.

8 Claims, No Drawings

KRAFT PULP BLEACHING AND RECOVERY PROCESS

This is a continuation, of application Ser. No. 390,324, filed Aug. 21, 1973, now abandoned which is a continuation of application Ser. No. 100,454, filed Dec. 21, 1970, now abandoned.

BACKGROUND OF THE INVENTION

1. Field of the Invention

The present invention relates generally to a method of bleaching Kraft pulp. More particularly the invention relates to a process for bleaching Kraft pulp comprising from one to about three treatments with ozone and a final treatment with an alkaline peroxide solution, the treatments being separated by an alkaline extraction. The fresh water requirement is reduced by utilizing effluent from the bleach treatments in subsequent bleaching operations and stream and air pollution is eliminated by utilizing the final effluent from the bleaching operation in the chemical recovery system of a Kraft pulping process.

2. Description of the Prior Art

Wood is composed of two main parts—a fibrous carbyhydrate or cellulosic portion and a non-fibrous portion comprising phenolic-type compounds, this latter portion being commonly referred to as lignin.

In the Kraft, or sulfate, pulping process wood chips are treated with a solution of sodium hydroxide and sodium sulfide which attacks the non-fibrous (lignin) portion of the wood so the individual fibers can be separated. The resulting pulp is then transferred to a brown stock washing system wherein chemicals are removed by washing with water. The effluent from the washing operation plus the spent cooking liquor from the digesters is commonly referred to as black liquor. The black liquor contains practically all the alkali originally added, plus about half the original weight of the wood chips. Weak black liquor is either recycled to the digester where it acts as a diluent for the fresh liquor, or it is treated as follows:

The weak black liquor (at approximately 15–20% solids) is treated in a series of evaporators, commonly referred to as a multiple effect evaporator, and is discharged to a direct contact evaporator where further water is evaporated until the solids content is approximately 65–70 %. The evaporated liquor is then screened and passed to a recovery unit where (a) make-up chemical or salt cake (sodium sulfate) is added; (b) the remaining water is removed; (c) sodium salts are recovered mostly as sodium carbonate and sodium sulfide; and (d) heat is obtained by burning the organic compounds in the liquor.

The molten ash, or smelt, from the recovery unit, which consists of sodium carbonate and sodium sulfide, is dissolved in water to form green liquor. The green color is due to iron impurities which, along with silica and other suspended solids, are removed by treatment with coagulating agents and settlement in a clarifier. The clarification step is followed by a causticizing step in which the green liquor is treated with lime (calcium oxide) to convert the sodium carbonate to sodium hydroxide, the sodium sulfide remaining unchanged. The sludge from the lime treatment is removed, and the resulting solution is referred to as white liquor which can be reused as cooking liquor in the digester. The sludge is washed in a lime mud washer and the filtrate used to dissolve additional smelt from the recovery unit. The lime mud is treated in a kiln to yield reburned lime. During the burning operation some calcium oxide and sulfur compounds are collected in the kiln stack and removed by a scrubber in said stack.

Unbleached Kraft, or sulfate, pulps are generally bleached to an acceptable brightness by a multistage process employing chlorine or chlorine-containing compounds such as calcium or sodium hypochlorite and chlorine dioxide. Although chlorine and chlorine-containing compounds have proven to be effective bleaching agents, these compounds are difficult to handle, introduce the problem of corrosion of the paper-making equipment, and render the effluents from the bleach plant incapable of being recovered and recycled. In addition waste liquors and wash water from the bleach plant incorporating such compounds can cause a serious pollution problem. The stream pollution problems associated with effluents from chlorine and/or chlorine-containing bleaching processes are well recognized, and it has been suggested that these effluents be concentrated and burned in the pulping liquor recovery system described above. However, this method of disposing of such effluents has several major disadvantages which have discouraged the use of such a recovery and disposal system for chlorine-containing bleach plant effluents. The chloride content of the effluent introduces the problems of corrosion, solid build up, volatilization of toxic compounds, etc. in the recovery system.

Ozone is a well known bleaching agent and has been suggested for use in bleaching wood pulp. In U.S. Pat. No. 396,325 to Brin et al. and in U.S. Pat. No. 1,957,937 to Campbell et al. ozone is used, in combination with chlorine, in a bleaching process. Because of the chloride content or the effluents these processes would not eliminate the pollution problems discussed above. Other systems which have employed ozone in a bleaching process, either alone or after the fibers were pretreated by exposure to U.V. light or with various chemical solutions, are also unacceptable, primarily because of the low brightness values obtained when compared to those obtained from chlorine containing bleaching processes available in the art.

SUMMARY OF THE INVENTION

In accordance with the present invention Kraft pulp is bleached to a high brightness by a bleaching sequence comprising from one to about three treatments with ozone, and a final treatment with an alkaline peroxide solution, the bleach treatments being separated by an alkaline extraction. The effluent from each of the bleach treatments is collected and either, recycled and utilized in subsequent bleaching operations thereby reducing the amount of fresh water required, or introduced into the chemical recovery system of a Kraft pulping process thereby eliminating pollution which would otherwise be caused by dumping these effluents.

DESCRIPTION OF THE PREFERRED EMBODIMENT

In practicing the process of this invention, the ozone treatments are best carried out by treating the pulp with a stream of oxygen containing from about 2% to about 4% ozone. Following each of the ozonation steps the pulp may be washed if desired. The ozonated pulp is then subjected to an alkaline extraction which preferably comprises treatment with an aqueous solution of sodium hydroxide at an increased temperature for a period of time ranging from about ½ to about 2 hours and after this time the pulp is diluted with fresh water or, preferably, with effluent from previous bleaching operations. The pulp is finally treated with an alkaline solution of hydrogen peroxide such as is commonly used in the bleaching of wood pulp and washed.

While it is preferred to subject the pulp to from 1 to about 3 treatments with ozone, the following bleaching sequence is especially preferred in carrying out this invention: ozonation, alkaline extraction, ozonation, alkaline extraction, peroxide treatment, and wash.

It has now been found that the amount of fresh water required for the bleaching operation can be substantially reduced if effluent from the various bleaching treatments is recycled and used in subsequent bleaching operations. It is especially preferred to introduce fresh water into the system at the final wash following the alkaline peroxide treatment and to utilize the effluent from one stage at an earlier stage in a subsequent bleaching operation. In the especially preferred bleaching sequence, effluent from the peroxide treatment and wash is used in the second alkaline extraction in a subsequent bleaching operation, and effluent from the second alkaline extraction is used in the first alkaline extraction in a subsequent operation. It is preferred not to reuse effluent from the first alkaline extraction, but to treat it as below in the chemical recovery system.

To eliminate stream and air pollution, effluent from the first alkaline extraction, and, if desired, from other bleaching treatments is introduced into the chemical recovery system associated with the Kraft pulping operation. The effluent can be introduced into this system at any point where fresh water is normally employed. It is preferred to introduce the effluent at the brown stock washer, the smelt dissolving operation, the lime mud washer or the kiln stack scrubber. If the volume of effluent is large, it may be separated and introduced at more than one of these points. It is especially preferred to introduce the effluent at the brown stock washer.

In order to describe the present invention so that it may be more clearly understood, the following examples are set forth. These examples are set forth primarily for the purpose of illustration, and any specific enumeration of detail contained therein should not be interpreted as a limitation on the concept of this invention.

EXAMPLE I

A mixture of hardwood (beech, birch and maple) chips was pulped via the Kraft process. Handsheets were prepared from the resulting pulp in accordance with TAPPI Standard T 281 m. Sheets produced in this manner had a brightness, as measured on a General Electric Photometer and expressed in terms of G.E. units, of 30 when measured in accordance with TAPPI Standard T 217 m.

The pulp was dewatered to 35% consistency in a basket centrifuge and the product was fluffed in a high speed fiber separator. The fluffed material was treated, in a countercurrent stream, with oxygen containing from 2% to 4% ozone. The rate of feed of the pulp was adjusted so that at a residence time in the ozonation equipment of 30 seconds and a temperature of 77° F. the amount of ozone consumed was 0.96% of the bone dry weight of the fibers.

The pulp was washed and, at a consistency of 11%, treated with an aqueous solution of 2% sodium hydroxide based on the bone dry weight of the pulp at 150° to 160° F. for 96 minutes. The pulp was diluted with water to a consistency of 1%. The consistency was thickened to 35% and the pulp was again treated with ozone, as above, so that the amount of ozone consumed was 0.87% of the bone dry weight of the pulp.

The pulp was again treated with an aqueous solution of sodium hydroxide containing 1% sodium hydroxide based on the bone dry weight of the pulp as above. The pulp was washed and again treated with ozone so that the amount of ozone consumed was 0.62% of the bone dry weight of the pulp.

A sample of the pulp was washed with water and handsheets were prepared as with the unbleached pulp. The brightness of this sheet was equal to 89.0 G.E. when measured as above for sheets from the unbleached pulp.

A second sample of the pulp was washed with an alkaline solution, thickened to 12% consistency and treated with an aqueous bleach solution comprising

| | |
|---|---|
| hydrogen peroxide | 0.4% |
| sodium hydroxide | 0.48% |
| sodium silicate | 1.0% |

The bleach solution was applied so that 0.4% hydrogen peroxide was added based on the bone dry weight of the pulp. After 3½ hours at 112° F. and a pH of between 9 and 10.2 the pulp was washed with water containing sulfurous acid. Sheets prepared as above had a brightness of from 90 to 91 G.E. and after one hour at 221° F. remained at between 89 and 90 G.E.

The effluent from the several bleaching operations is collected and introduced into the chemical recovery system of the Kraft pulping process.

EXAMPLE II

Midwestern poplar chips were pulped via the Kraft process. Handsheets prepared as in Example I had a brightness of 30 G.E. units.

A sample of the pulp was fluffed and subjected to a first ozone treatment as in Example I. The amount of ozone consumed was equal to 1.28% of the bone dry weight of the fibers.

After washing the pulp was treated with an aqueous solution of 1.5% sodium hydroxide based on the bone dry weight of the pulp as in Example I.

Following a second ozonation in which the ozone consumed was equal to 0.90% of the bone dry weight of the fibers and a second alkali treatment, this time with an aqueous solution containing 0.5% sodium hydroxide based on the bone dry weight of the pulp, the pulp was treated with an aqueous solution comprising:

| | |
|---|---|
| hydrogen peroxide | 0.2% |
| sodium hydroxide | 0.25% |
| sodium silicate | 1.0% |

All of these treatments were carried out as in Example I except for the amounts of reagents employed.

Handsheets prepared from the pulp had a brightness of 88.5 G.E. and after one hour at 221° F. retained a brightness of 86.5 G.E.

EXAMPLE III

A second sample of the unbleached pulp prepared in Example II was bleached by a method identical with that disclosed in Example II except that the fresh water utilized in the second alkali extraction in that example was replaced by the effluent from the peroxide treatment in Example II.

Handsheets prepared from pulp bleached in this manner had a brightness of 90.0 G.E. and after 1 hour at 221° F. retained a brightness of 88.5 G.E.

EXAMPLE IV

A third sample of the unbleached pulp prepared in Example II was bleached by a method identical with that disclosed in Example II except for two modifications. The fresh water in the second alkali extraction was replaced by the wash water from the peroxide treatment in Example III. Also the fresh water in the first alkali extraction was replaced by the effluent from the second alkali extraction in Example III.

Handsheets prepared from pulp bleached in this manner had a brightness of 89.3 G.E. and after 1 hour at 221° F. retained a brightness of 87.9 G.E.

The effluent from the first alkali extraction is introduced into the chemical recovery system of the Kraft pulping process at the brown stock washer.

EXAMPLE V

A mixture of hardwood chips (beech, birch and maple) were pulped via the Kraft process. Handsheets prepared as in Example I had a brightness of 30 G.E. units.

The pulp was dewatered to 35% consistency in a basket centrifuge and the product was fluffed in a high speed fiber separator. The fluffed material was treated, in a countercurrent stream, with oxygen containing 2.53% ozone based on the bone dry weight of the pulp. The amount of ozone consumed was equal to 0.96% of the bone dry weight of the fibers.

The ozonated pulp was treated with an alkaline solution and thereafter bleached at 12% consistency with an aqueous solution comprising 0.27% hydrogen peroxide, 5% sodium silicate and 0.75% sodium hydroxide for 4½ hours at 113° F. Handsheets, prepared and tested as in Example I, had an average brightness of between 84 and 85 G.E. units.

Effluent from the bleach treatments is collected and utilized in subsequent bleaching operations or in the chemical recovery system of a Kraft pulping process.

What is claimed is:

1. In a method of kraft wood pulping including a kraft chemical recovery system and a kraft wood pulp bleaching operation, the improvement which comprises bleaching the kraft wood pulp by a sequence of treatments comprising:

from one to about three treatments with ozone;

a final treatment with an alkaline peroxide solution;

separating the treatments with alkaline extractions;

recycling effluent from the alkaline extractions and alkaline peroxide treatment to reduce the fresh water requirements of the bleaching operations; and introducing effluent from the bleaching operation into the kraft pulp chemical recovery system;

wherein the method is free of any treatments employing chlorine or chlorine-containing compounds and;

whereby the need for treating the effluent being introduced into the kraft pulp chemical recovery system for the removal of chlorine containing salts is eliminated.

2. A method as recited in claim 1 in which the effluent from the alkaline peroxide treatment is used in an alkaline extraction step in a subsequent bleaching operation.

3. A method as recited in claim 1 in which the effluent from a second or third alkaline extraction is used in an earlier alkaline extraction in a subsequent bleaching operation.

4. A method as recited in claim 1 in which the number of ozone treatments is 2.

5. A method as recited in claim 1 in which the effluent from the bleaching operation is utilized at the brown stock washer in the recovery system.

6. A method as recited in claim 1 in which the effluent from the bleaching operation is utilized to dissolve the smelt in the recovery system.

7. A method as recited in claim 1 in which the effluent from the bleaching operation is utilized at the lime mud washer.

8. A method as recited in claim 1 in which the effluent from the bleaching operation is utilized in the kiln stack scrubber.

* * * * *